United States Patent [19]

Carasso et al.

[11] 4,139,795

[45] Feb. 13, 1979

[54] TELEVISION CAMERA TUBE

[75] Inventors: Marino G. Carasso; Paulus P. M. Schampers, both of Eindhoven, Netherlands

[73] Assignee: U.S. Philips Corporation, New York, N.Y.

[21] Appl. No.: 758,476

[22] Filed: Jan. 11, 1977

[30] Foreign Application Priority Data

Jan. 16, 1976 [NL] Netherlands ..... 7600425

[51] Int. Cl.[2] ..... H01J 29/45; H01J 31/38

[52] U.S. Cl. ..... 313/384; 313/372

[58] Field of Search ..... 313/384, 385, 386, 367, 313/372, 371, 94

[56] References Cited

U.S. PATENT DOCUMENTS

| | | | |
|---|---|---|---|
| 2,881,340 | 4/1959 | Rose | 313/384 |
| 3,026,416 | 3/1962 | Weimer | 313/371 X |
| 3,523,208 | 8/1970 | Bodmer et al. | 313/367 X |
| 3,735,177 | 5/1973 | Weijland et al. | 313/384 X |
| 3,858,079 | 12/1974 | Miyama et al. | 313/384 X |
| 3,867,662 | 2/1975 | Endriz | 313/94 |
| 3,873,829 | 3/1975 | Evrard et al. | 313/94 X |
| 3,940,651 | 2/1976 | Hofstein | 313/392 X |
| 3,997,810 | 12/1976 | Tsutsui et al. | 313/371 X |

FOREIGN PATENT DOCUMENTS

| | | | |
|---|---|---|---|
| 2125709 | 12/1971 | Fed. Rep. of Germany | 313/384 |

*Primary Examiner*—Robert Segal

*Attorney, Agent, or Firm*—Carl P. Steinhauser

[57] ABSTRACT

A photoconductive layer which is vapor-deposited on a carrier in a television camera tube is provided with a structure of regions having at least one dimension which corresponds in the order of magnitude, measured transversely of the layer, to the transverse dimension of an image point in the layer. These regions are separated by partitions which consist of the same material as the further conductive layer, but for which the structure is such that they exhibit a comparatively low transverse conduction.

10 Claims, 5 Drawing Figures

TELEVISION CAMERA TUBE

The invention relates to a television camera tube, comprising an electron source for scanning a target provided with a photoconductive layer which is deposited on a carrier comprising a signal electrode.

The transverse conduction in the photoconductive layer of such a television camera tube can have an image-disturbing effect, notably in the case of special applications. In an application where a charge image formed on the target, for example, for image integration over a plurality of frame times, is not directly read, the definition of an image to be formed can be substantially affected thereby. Situations of this kind can occur, for example, during the recording of images at a low illumination level, in medical X-ray television chains and in so-termed slow-scan reading methods. This transverse conduction can also cause image blurring, be it to a small extent, in normal television applications.

The transverse conduction in the photoconductive layer of these tubes is comparatively low indeed, but particularly favourable properties, of, for example, the camera tube comprising a photoconductive layer consisting of lead oxide, known by the Philips trade name "Plumbicon", have been sacrificed.

The invention has for its object to provide a television camera tube in which the transverse conduction in the photoconductive layer is substantially reduced without sacrifice of favourable properties of the photoconductive material.

To this end, a camera tube of the kind set forth in accordance with the invention is characterized in that the photoconductive layer has a structure of regions having at least one transverse dimension which corresponds in order of magnitude to, but is not larger than, a transverse dimension of an image point in the layer, these regions being at least partly separated from each other by transitions in the photoconductive layer which have electrical properties which deviate substantially from those of the photoconductive material in a central portion of the regions.

The transverse conduction in the layer is substantially reduced by providing the photoconductive layer in a cameratube in accordance with the invention with transitions which have a comparatively high contact resistance and which transversely intersect the layer. In a preferred embodiment, a layer of lead oxide is vapour-deposited on a signal electrode which is provided on a carrier in which a structure of higher and lower portions is provided, for example, by etching. If vapour deposition is effected in favourable conditions, material which is deposited on both sides of transitions between the higher and the lower portions readily grows together, at least macroscopically viewed. Walls are then formed which have a comparatively high contact resistance. In walls of this kind, moreover, the porous microcrystalline lead oxide has a comparatively low dielectric constant relative to a commonly used uninterrupted layer. This property, whereby the local capacitance of the layer is greatly reduced, is utilized in a further preferred embodiment. In a preferred embodiment of a target in accordance with the invention, the regions have an extent which equals, for example, approximately half the size of an image element in the layer.

Some preferred embodiments of camera tubes in accordance with the invention will be described in detail hereinafter with reference to the diagrammatic drawing.

FIG. 5 shows another embodiment employing a fiber optic window.

Figure 1:
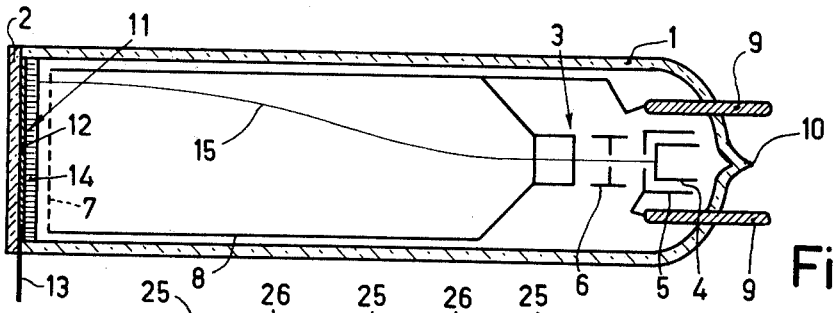
FIG. 1 is a diagrammatic view of a camera tube comprising a target in accordance with the invention.

A camera tube of the vidicon type comprises, accommodated in a vacuum space a wall of which is formed by a glass tube 1 with an entrance window 2, an electron gun 3 comprising a cathode 4, a control grid 5, a second grid 6 and an output electrode 8 which is terminated by a gauze electrode 7. For the supply of the necessary power and voltages, connection pins 9 are provided on one end of the tube where a pumping stem is also situated.

The entrance window 2 comprises a target 11 which comprises as usual a signal electrode 12 with a connection contact 13 and a photoconductive layer 14. The photoconductive layer in a "Plumbicon" consists essentially of lead monoxide which is vapour-deposited with a layer thickness of, for example, approximately 20 microns on a signal electrode which is made of, for example, tin oxide. A vapour-deposited layer of lead oxide of this kind has a micro-crystalline, more or less porous structure. An electron beam 15 scans the target under the control of an electro-magnetic or electrostatic focussing and deflection system (not shown). A charge image formed on the photoconductive layer by incident image information is then read and the target is stabilized at a uniform potential again.

Figure 2:
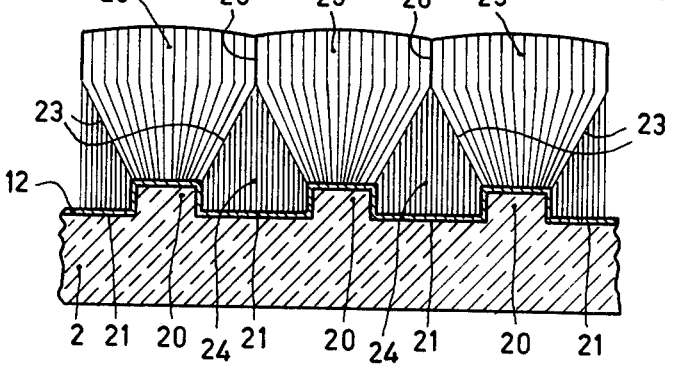
FIG. 2 is a diagrammatic sectional view of a part of such a target.

In accordance with the invention, the lead oxide layer comprises walls which intersect the layer more or less transversely and which divide the layer into a structure which impedes the charge transport between different image points. In a preferred embodiment of such a structure, shown in FIG. 2, the walls are formed by utilizing a substrate in which a structure of higher portions 20 and lower portions 21 is provided. In practical tubes the substrate is formed by the entrance window. A level difference of at least approximately 0.2 to 0.5 microns between the higher and the lower regions appears to be satisfactory. On this substrate first the signal electrode 12 is provided. This electrode is formed as a continuous, electrically conductive layer having such a small thickness that the structure in the carrier is not substantially blurred thereby. When subsequently photoconductive material such as lead oxide is vapour-deposited, the transitions between the higher portions and the lower portions continue in the vapour-deposited layer as partitions 23. A layer structure as shown in the FIGS. 2 and 3, with mutually separated regions 24 and 25, is thus obtained. The partitions 23 extend slightly obliquely from the transitions, so that during the further growth of the lead oxide layer a change occurs in the mutual surface area ratios of the various regions. If two transitions meet each other during the further growth, they together form a wall 26 which extends at least substantially transversely of the layer. Initially the mosaic structure in the layer is thus maintained during further vapourdeposition.

Figure 3:
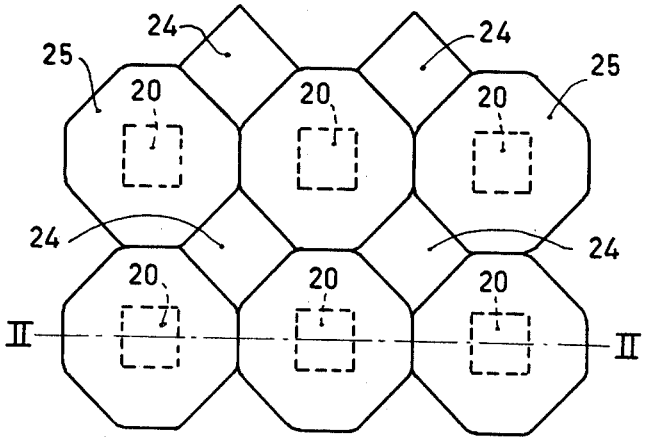
FIG. 3 is a diagrammatic plan view of a part of this target.

FIG. 3 shows a plan view of such a layer in a situation where the transitions have just formed the common walls 26. Only comparatively small surface areas of the regions 24 above the lower section of the substrate are still visible. These regions continuously decrease during further vapour-deposition and finally disappear completely. In a practical target, the raised portions 20 of the substrate form, for example, squares having a meeting edge of a few microns and situated at a pitch of approximately 10 microns from each other. The resistance of the lead oxide in the walls of a lead oxide layer thus composed is larger, for example, by a factor 100, than the resistance of lead oxide vapour-deposited on a flat substrate under the same circumstances.

Figure 4:
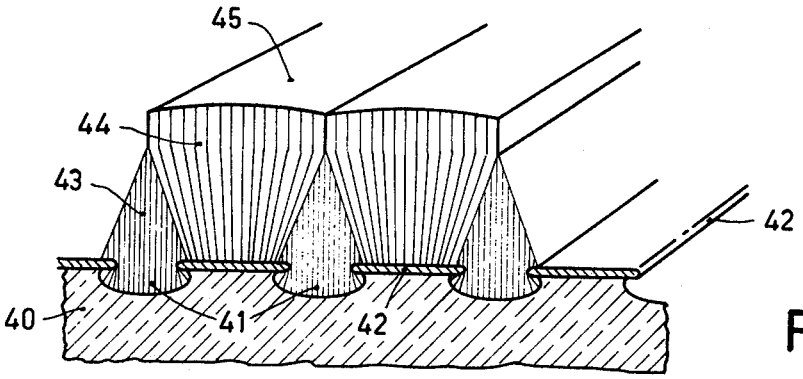
FIG. 4 shows a further preferred embodiment of a target in accordance with the invention.

As a result of the dimensions and the pitch of the raised portions 20, the relationship between the surface areas of the various regions can be varied, so that the layer thickness at which the transitions form coinciding walls can also be varied. Structures having a different shape can alternatively be provided in the substrate, for example, a pattern of dikes on the substrate or of grooves in the substrate. Irregularities of this kind also continue in the layer as transitions having a substantially higher resistance. A two-dimensional as well as a one-dimensional subdivision in the layer can be realized by means of such substrate structures. In the latter case a pattern of strips which are separated from each other by walls of increased resistance is formed. FIG. 4 shows a target of this kind. In a carrier 40 lower strips 41, formed by underetching, project slightly underneath upper (tin oxide) strips 42. As a result, the mutual deviations in the properties of the material 43 deposited on the lower portions and of the material 44 deposited on the raised portions are intensified. Consequently, a distinct difference occurs in the dielectric constant of the material 43 and the material 44. As a result, the capacitive coupling between the strips 45 themselves is substantially reduced so that, for example, substantially less colour mixing due to transverse conduction occurs in a colour camera tube comprising this layer structure than in a corresponding tube comprising a homogeneous photoconductive layer. A preferred embodiment of such a camera tube for colour television comprises an entrance window which is provided with a strip structure of colour filters which corresponds to the strip structure of the photo-conductive layer.

In a further embodiment of a camera tube in accordance with the invention, the entrance window is formed by a plate of structured material in which a level structure is provided on the side facing the target by introducing a difference in the height of different elements in the plate. For example, a structure can be formed by introducing a difference in the height of the cores 46 and the jackets 47 of optical fibres of a fibre-optical plate 46 (see FIG. 5). This can be realized, for example, by utilizing a difference in etchability of the two kinds of glass used in a suitable etching bath. Preferably, the jacket glass is etched away more, so that the cores form raised portions corresponding to the raised portions 20 of FIG. 2.

A substrate for a target in accordance with the invention can be manufactured, instead of by an etching process, by impressing a pattern in a mould into a slightly soft carrier such as, for example, glass which has been heated to a sufficiently high temperature. A structure can also be obtained by providing grains, for example, glass grains, on a carrier surface in an adhesive manner.

An attractive further aspect of a camera tube in accordance with the invention consists in that the walls in the layer also impose a given restriction as regards transverse scattering of light incident on the photoconductive layer. Notably red light may give rise to a given image blurring, because it is intercepted less readily by lead monoxide in a "Plumbicon". It has been found that light reflections occur on the transitions provided in accordance with the invention, so that light scattering in the layer is reduced. When a target in accordance with the invention is exposed to the effect of a suitable substance such as, for example, a sulpher compound, it appears that additional "blackening" occurs in the walls in the layer, so that the said additional aspect is intensified. Even though the described embodiments are based on the use of lead oxide as the photoconductive material, the invention is by no means restricted thereto, because the severe requirement of comparatively low transverse conduction to be imposed on the photoconductive material has been eliminated according to the invention.

What is claimed is:

1. A television camera tube, comprising an electron source, a target positioned to be scanned by an electron beam from said source and having a photoconductive layer and a signal electrode in contact with said photoconductive layer, the photoconductive layer having a plurality of regions each having at least one transverse dimension which corresponds in order of magnitude to, but is not larger than, a transverse dimension of an image point in the layer, said regions being at least partly separated from each other by wall transitions having a relatively large contact resistance which transversely intersect and divide the photoconductive layer into a structure which impedes charge transport between different image points.

2. A television camera tube as claimed in claim 1, wherein the photoconductive material is supported on a carrier having a surface which is provided with a structure forming wall transitions in the layer which transversely intersect the photoconductive layer.

3. A television camera tube as claimed in claim 2, wherein the structure in the carrier consists of alternately upper and lower portions.

4. A television camera tube as claimed in claim 2, wherein the structure is formed by a pattern of lines having a varying height relative to the substrate surface.

5. A television camera tube as claimed in claim 1, wherein an entrance window which acts as a carrier is a fibre-optical plate, the structure therein being formed by relative differences in the height of core glass and jacket glass of the fibre-optical plate.

6. A television camera tube as claimed in claim 1 wherein the structure in the photoconductive layer has a pattern of parallel strips.

7. A television camera tube as claimed in claim 6, wherein the substrate for the target has a strip structure which continues into the signal electrode as well as into the photoconductive layer.

8. A television camera tube as claimed in claim 7, wherein the strip structure in the carrier consists of raised portions which are separated by channels, the signal electrode strips present on the raised portions extending partly over the channels in the carrier.

9. A television camera tube as claimed in claim 6 wherein an entrance window which acts as a carrier for the target comprises a pattern of colour filter strips which corresponds to the strip pattern in the photoconductive layer.

10. A television camera tube as claimed in claim 1 wherein the photoconductive material consists essentially of lead monoxide.

* * * * *